United States Patent [19]

Peterson

[11] Patent Number: 4,660,236

[45] Date of Patent: Apr. 28, 1987

[54] FREE-ENGAGING DRIVE UNIT FOR ADJUSTABLE BEDS

[75] Inventor: Warren J. Peterson, Stevens Point, Wis.

[73] Assignee: Joerns Healthcare, Inc., Stevens Point, Wis.

[21] Appl. No.: 782,225

[22] Filed: Sep. 30, 1985

[51] Int. Cl.[4] ..... A61G 7/06

[52] U.S. Cl. ..... 5/69; 5/66; 5/53 R; 403/26

[58] Field of Search ..... 5/60–69, 5/53 R; 403/26, 194, 197, 238, 239

[56] References Cited

U.S. PATENT DOCUMENTS

| | | | |
|---|---|---|---|
| Re. 27,966 | 4/1974 | Burst | 5/67 |
| 1,775,547 | 9/1930 | Bayer | 5/69 |
| 2,912,704 | 11/1959 | Burst | 5/60 |
| 2,913,300 | 11/1959 | Darnell et al. | 5/68 |
| 3,045,256 | 7/1962 | Scher | 5/63 |
| 3,237,212 | 3/1966 | Hillenbrand et al. | 5/68 |
| 3,267,493 | 8/1966 | Pruim et al. | 5/63 |
| 3,271,795 | 9/1966 | Hillenbrand et al. | 5/63 |
| 3,281,872 | 11/1966 | Dewey | 5/63 |
| 3,281,873 | 11/1966 | Stanley et al. | 5/68 |
| 3,436,769 | 4/1969 | Burst | 5/67 |
| 3,571,826 | 3/1971 | Burst | 5/67 |
| 3,919,727 | 11/1975 | Paine | 5/63 |
| 4,225,988 | 10/1980 | Carey et al. | 5/61 |
| 4,545,084 | 10/1985 | Peterson | 5/69 |

FOREIGN PATENT DOCUMENTS

| | | | |
|---|---|---|---|
| 705064 | 3/1965 | Canada | 5/63 |

OTHER PUBLICATIONS

"Quick Change 3 in 1 Bed System T.M." by Joerns Healthcare, Inc.

*Primary Examiner*—John E. Murtagh
*Assistant Examiner*—Andrew Joseph Rudy
*Attorney, Agent, or Firm*—Price, Heneveld, Cooper, DeWitt & Litton

[57] ABSTRACT

A free-engaging drive unit is provided for adjustable beds and the like of the type having a mattress support frame or bedspring supported by two detachable end panels. A crank is mounted on one of the end panels, preferably at the foot of the bed, and is positioned at a conveniently accessible height and location. The adjustable bed has at least one controller shaft, which is rotated to adjust an associated portion of the bed. The free-engaging drive unit includes a drive coupling mounted on the foot end panel and a mating driven coupling mounted on an adjacent portion of the bedspring. When the foot end panel is connected with the bedspring, the drive and driven couplings automatically mesh to operatively connect the crank with the controller shaft, and thereby effect bed adjustment.

41 Claims, 11 Drawing Figures

FREE-ENGAGING DRIVE UNIT FOR ADJUSTABLE BEDS

CROSS REFERENCE TO RELATED APPLICATIONS

The present application is related to co-pending U.S. patent application Ser. No. 576,580, now U.S. Pat. No. 4,545,084, filed Feb. 3, 1984, entitled Modular Drive Arrangement for Adjustable Beds and The Like, which is hereby incorporated by reference.

BACKGROUND OF THE INVENTION

The present invention relates to adjustable beds, and the like, and in particular to a free-engaging drive unit therefor.

Adjustable beds are well known, and are used extensively in hospitals, nursing homes, health care facilities and institutions, as well as home care applications, to assist in the care and treatment of invalids. Such adjustable beds have at least one controller shaft that is rotated axially to manipulate an associated adjustable portion of the bed, such as the bed height, head tilt, foot tilt, and other bed functions. Fully adjustable beds normally have a separate controller shaft associated with each independently adjustable portion of the bed.

Some adjustable beds, such as the unit illustrated and described in the Applicant's above-identified related application, and in the "Quick Change 3 in 1 Bed System TM" brochure by Joerns Healthcare, Inc. as identified in the Disclosure Statement, and hereinafter collectively referred to as "Joerns modular drive bed," have a separate mattress support frame or bedspring supported by two detachable end panels. The bedspring and the end panels are interconnected by mating keeper pins and corner hooks, so that the bed can be easily assembled and disassembled without tools. This type of bed construction greatly facilitates manufacture, shipping, delivery, storage and repair.

In the Joerns modular drive bed, the manual crank units are supported on the frame, at the foot end of the bed. Manipulation of the manual crank units therefore requires that the attendant bend over or crouch to a somewhat uncomfortable position. Hence, it would be advantageous to provide a drive unit to operate the manual crank units from a more convenient height and location on the bed. Furthermore, it would also be advantageous to provide a drive unit that would automatically couple when the bed was fully assembled, and would self-adjust for any slight misalignment that might exist between the mattress support frame and the end panels.

SUMMARY OF THE INVENTION

One aspect of the present invention is a free-engaging drive unit for adjustable beds of the type having a mattress support frame or bedspring supported by two detachable end panels. A crank is rotatably mounted on a conveniently accessible portion of one end panel, preferably at the foot end of the bed. The adjustable bed has at least one controller shaft that is rotated axially to adjust an associated portion of the adjustable bed. The free-engaging drive unit includes a drive coupling member connected with the foot end panel, and a driven coupling member connected with the bedspring. When the foot end panel is connected with the bedspring, the drive and driven coupling members automatically mesh to operatively connect the crank with the controller shaft, and thereby effect bed adjustment.

The drive and driven coupler member preferably include a bent drive finger and mating, two-pronged claw which consistently mesh together without any special synchronization. The mating drive finger and claw self-adjust for any slight misalignment between the bedspring and the foot panel of the bed. An annularly shaped bushing is rotatably mounted on the drive finger to reduce noise and wear, particularly when the drive finger and claw are not perfectly aligned. A quick-disconnect arrangement may be used to mount the free-engaging drive unit on the bed to provide a removable module that can be replaced by a motorized drive unit.

The principal objects of the present invention are to provide a manual drive unit for adjustable beds which has free-engaging coupling members on the bedspring and mating bed end panel that automatically mesh without any special synchronization when the bed is assembled. The two halves of the drive unit are self-adjusting to accommodate for any minor misalignment therebetween. The drive unit can also be quickly installed in the adjustable bed by even relatively unskilled personnel without any tools. The drive unit is efficient in use, economical to manufacture, capable of a long operating life, and particularly well adapted for the proposed use.

These and other features, advantages, and objects of the present invention will be further understood and appreciated by those skilled in the art by reference to the following written specification, claims and appended drawings.

DETAILED DESCRIPTION OF THE PREFERRED EMBODIMENTS

Figure 1:
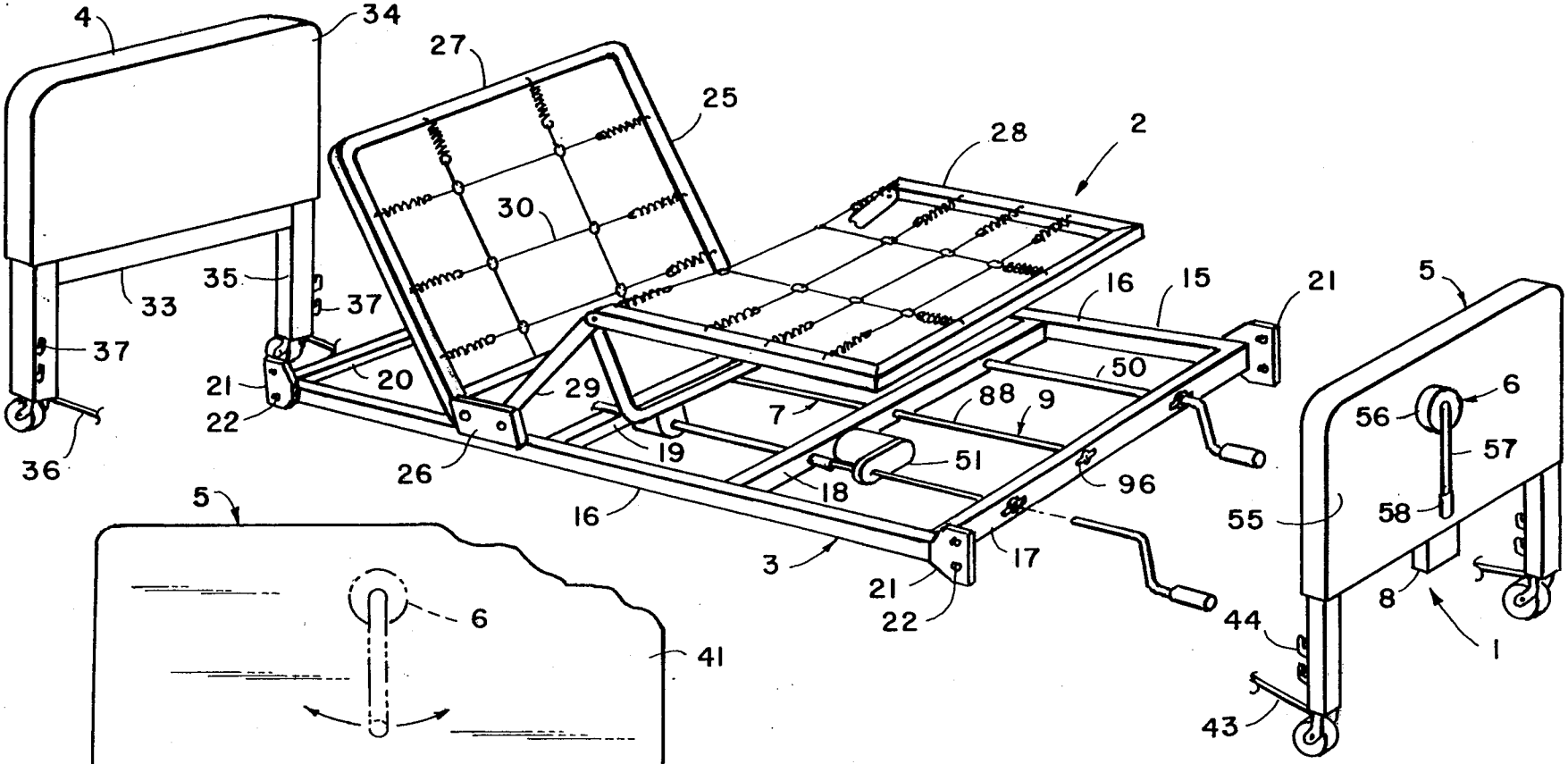
FIG. 1 is a partially schematic, exploded, perspective view of an adjustable bed, having a free-engaging drive unit embodying the present invention.
Figure 5:
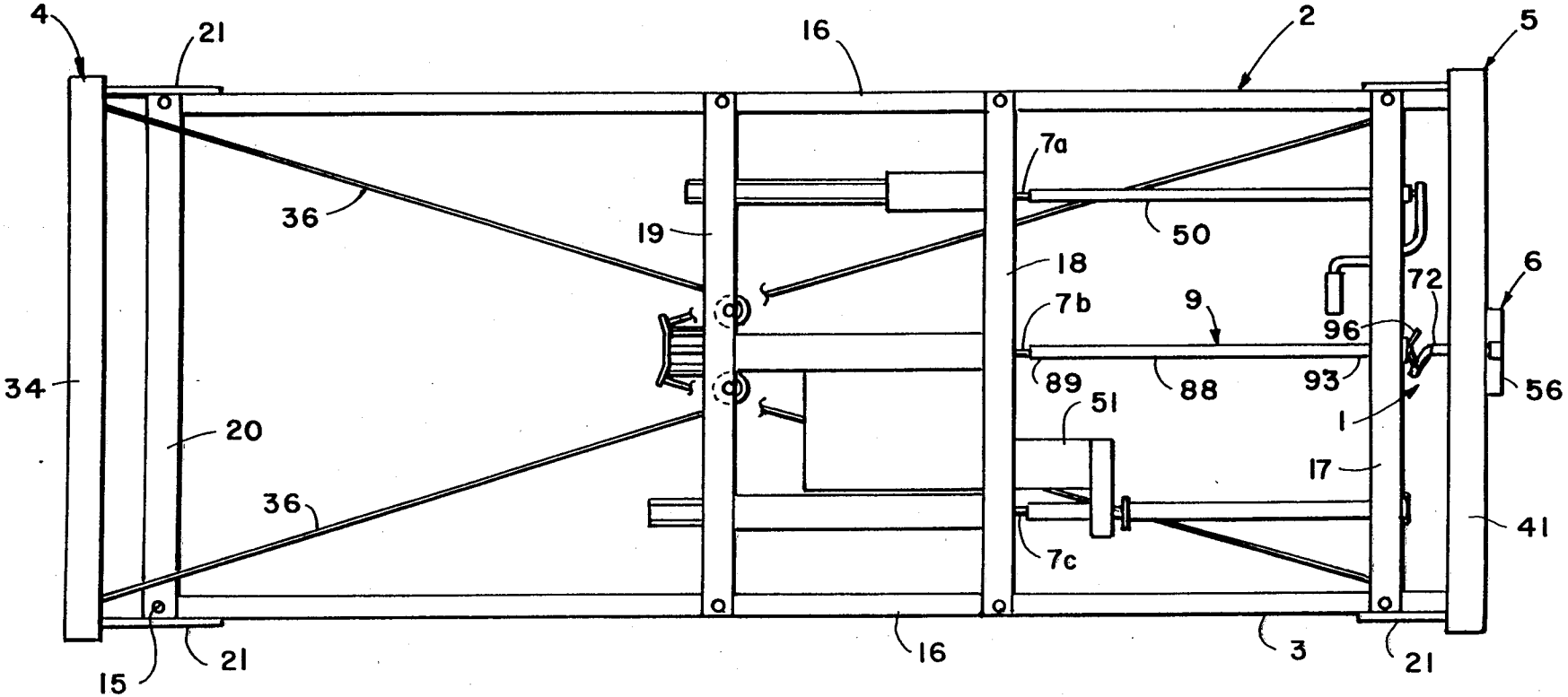
FIG. 5 is a top plan view of the adjustable bed.
Figures 6, 7, 8, 9:
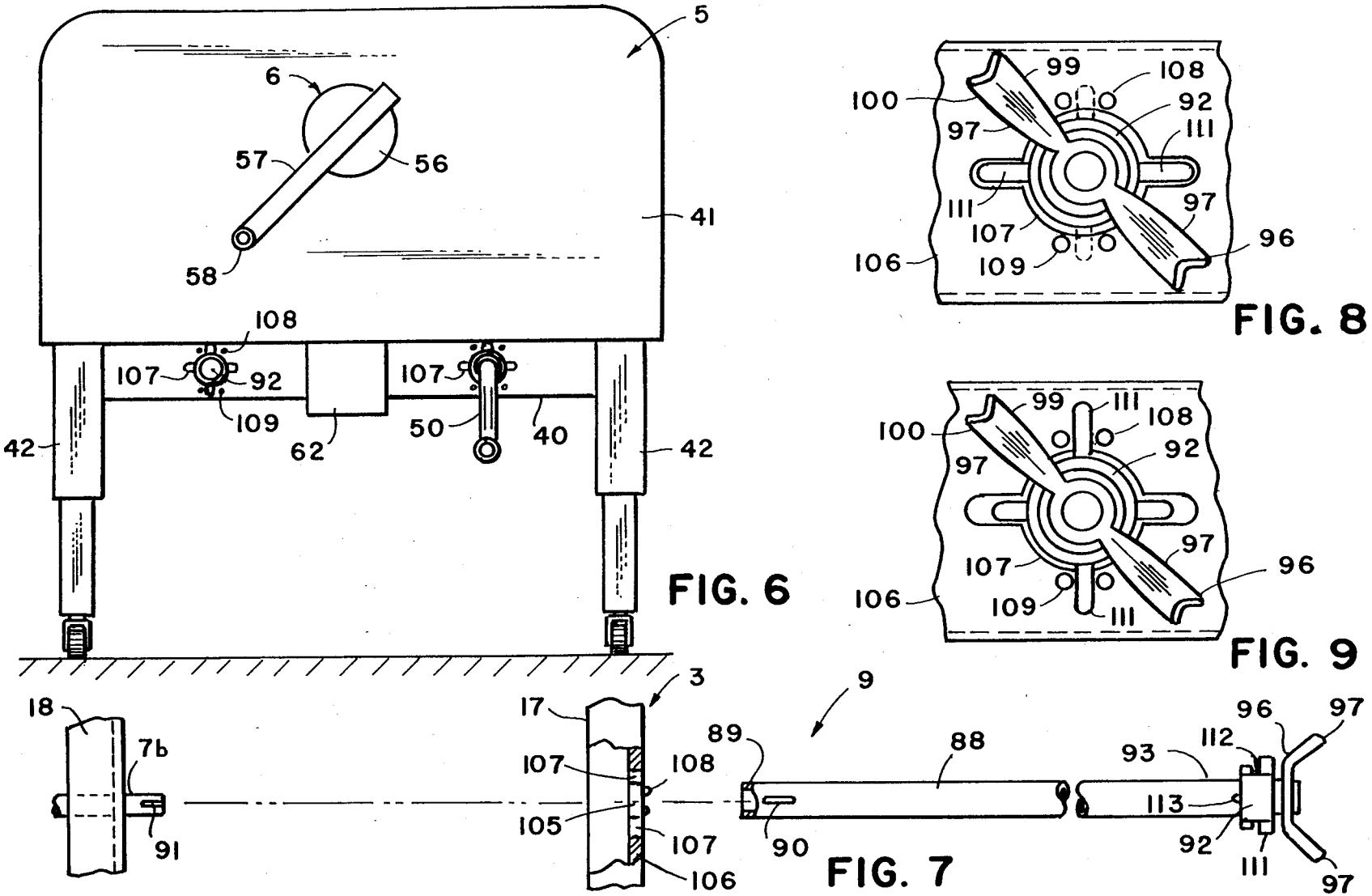
FIG. 6 is an end elevational view of a foot end of the adjustable bed.
FIG. 7 is an exploded, fragmentary view of a driven portion of the free-engaging drive unit, shown disassembled from the adjustable bed.
FIG. 8 is an end elevational view of the driven portion of the drive unit, shown in an unlocked position in the bed.
FIG. 9 is an end elevational view of the driven portion of the drive unit, shown in a locked position in the bed.

For purposes of description herein, the terms "upper," "lower," "right," "left," "rear," "front," "vertical," "horizontal," and derivatives thereof shall relate to the invention as oriented in FIGS. 1 and 5. However, it is to be understood that the invention may assume various alternative orientations, except where expressly specified to the contrary.

The reference numeral 1 (FIG. 1) generally designates a free-engaging drive unit embodying the present invention. Free-engaging drive unit 1 is particularly adapted for use in conjunction with an adjustable bed 2, and other similar beds of the type having a mattress support frame or bedspring 3 supported by detachable end panels 4 and 5. A crank 6 is mounted on one of the end panels 4 and 5 of adjustable bed 2 at a conveniently accessible height and location thereon. Crank 6 is adapted to manipulate at least one controller shaft 7 to adjust an associated portion of adjustable bed 2. Free-engaging drive unit 1 includes a drive coupling member 8 mounted on end panel 5, and a driven coupling member 9 mounted on an adjacent portion of bedspring 3. When end panel 5 is connected with bedspring 3, the drive and driven coupling members 8 and 9 automatically mesh to operatively connect crank 6 with controller shaft 7, and thereby effect bed adjustment. No adjustments or tools are required to mate the two coupling halves 8 and 9.

Except for the unique free-engaging drive unit 1 disclosed herein, the illustrated adjustable bed 2 is substantially identical to the bed illustrated and described in the Joerns "Quick Change 3 in 1 Bed System TM" brochure identified in the Disclosure Statement. Specifically, bedspring 3 includes a stationary frame section 15, having a substantially rectangular plan configuration, with side rails 16 interconnected by laterally extending cross members 17–20. Mounting plates 21 are fixedly attached to each corner of stationary frame 15, and extend longitudinally outwardly therefrom. Each mounting plate 21 includes two outwardly protruding keeper studs 22 to facilitate detachably connecting the same with end panels 4 and 5, as described in greater detail hereinafter.

An adjustable frame section 25 (FIG. 1) is connected to stationary frame section 15 by a pair of opposing hinges 26. The illustrated adjustable frame 25 includes a head section 27, a foot section 28, and a seat section 29. A spring assembly 30 is mounted in adjustable frame section 25, and is adapted to support a mattress (not shown) thereon.

The head panel 4 of adjustable bed 2 includes a frame 33, a headboard 34 attached thereto, and vertically adjustable legs 35. Cables 36 are connected with legs 35, and are tensed to telescopingly extend and retract legs 35 to raise and lower the head end of adjustable bed 2. Corner hooks 37 are attached to the opposite sides of head panel frame 33, and are adapted to receive the keeper studs 22 on mounting plates 21 therein to detachably connect bedspring 3 with head panel 4.

Foot panel 5 (FIGS. 1 and 2) is substantially similar in construction to head panel 4, and includes a frame 40, a foot board 41 mounted thereon, vertically adjustable legs 42, actuator cables 43 for legs 42, and corner hooks 44.

The illustrated adjustable bed 2 (FIG. 5) has three variable functions, and three corresponding controller shafts *7a*, *7b* and *7c*. Controller shaft *7a* pivots the head section 27 of adjustable bed 2. Controller shaft *7b* controls tension on adjustment cables 36 and 43 to adjust the vertical position or elevation of bedspring 3 with respect to the floor. Controller shaft *7c* controls a combination adjustment for foot section 28 and seat section 29. In the illustrated example, the head tilt controller shaft *7a* is manipulated by a manual crank unit 50, and the combination foot and center section controller shaft *7c* is manipulated by a motor drive unit 51. Motor drive unit 50 and manual crank unit 51 are substantially identical in construction to the drive units described and illustrated in the Applicant's above-identified related application.

Crank 6 (FIGS. 1 and 2) is rotatably mounted on one of the end panels 4 and 5 of adjustable bed 2. Preferably, crank 6 is mounted on the exterior side 55 of foot panel 5, at a generally waist high elevation. Crank 6 comprises a hub 56, and a crank arm 57 having one end thereof connected with hub 56, and the opposite end thereof attached to a pivoting handle 58.

Figure 4:
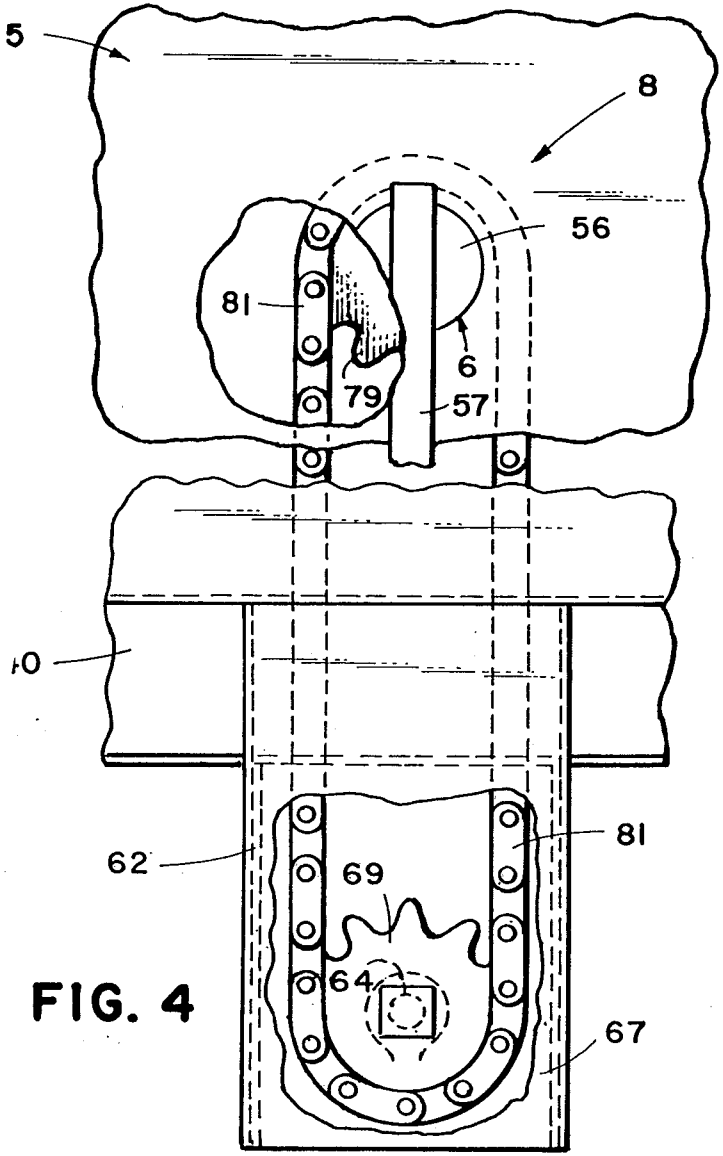
FIG. 4 is a fragmentary, end elevational view of the free-engaging drive unit, with portions thereof broken away to reveal internal construction.
Figure 3:
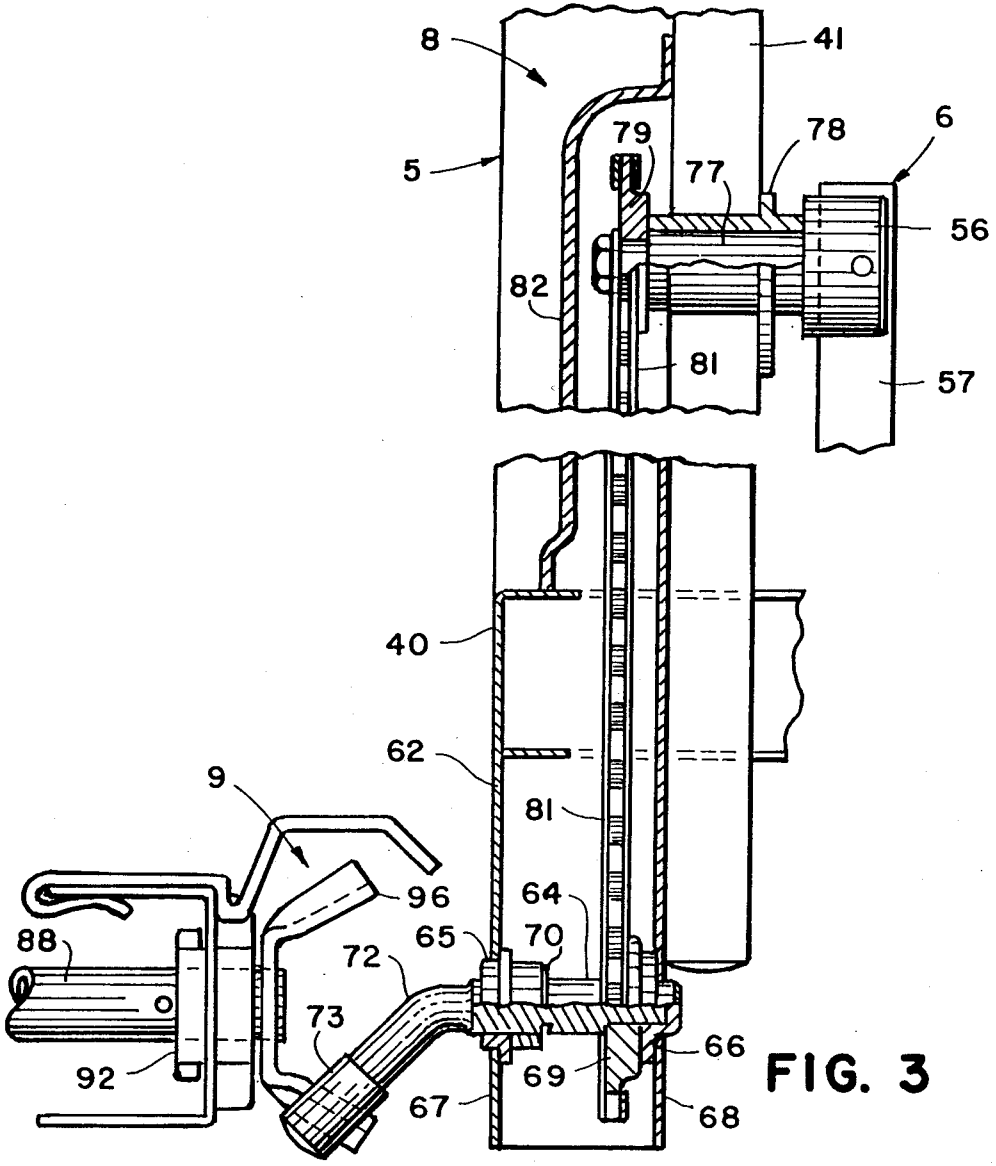
FIG. 3 is a fragmentary, vertical cross-sectional view of the free-engaging drive unit.

With reference to FIGS. 3 and 4, drive coupling member 8 comprises a housing 62 fixedly attached to the lowermost cross member of foot panel frame 40. Housing 62 has a substantially rectangular plan configuration, and a hollow interior. A first drive shaft 64 is rotatably mounted in housing 62 for axial rotation about a longitudinal axis of the drive shaft. In the illustrated example, bearings 65 and 66 rotatably mount first drive shaft 64 to the forward and rearward walls 67 and 68 respectively of housing 62 in a generally horizontal orientation. A sprocket 69 is mounted on first drive shaft 64 between bearings 65 and 66, and rotates therewith for purposes to be described hereinafter. A snap ring 70 is positioned in a mating groove in first drive shaft 64 to locate the same axially or longitudinally in housing 62.

A rigid drive arm 72 is connected with first drive shaft 64 for rotation therewith, and protrudes radially outwardly from the longitudinal axis of the first drive shaft 64. In the illustrated example of the present invention, drive arm 72 comprises a single, bent finger which is integrally formed with first drive shaft 64, and projects forwardly toward the head panel 4 of adjustable bed 2. The illustrated drive arm 72 is oriented at an angle of approximately 50 degrees from the longitudinal axis of first drive shaft 64, and projects forwardly a distance in the nature of 1 to 2 inches. A bushing 73 is rotatably mounted on the outer end of drive arm 72, and is positioned thereon to abut a mating portion of driven coupling member 9, as discussed in greater detail hereinafter. Bushing 73 is annularly shaped, and is preferably constructed from a resilient, self-lubricating material, such as an acetal compound to reduce wear and noise, particularly when the drive and driven coupling members 8 and 9 are not in perfect alignment.

Figure 2:
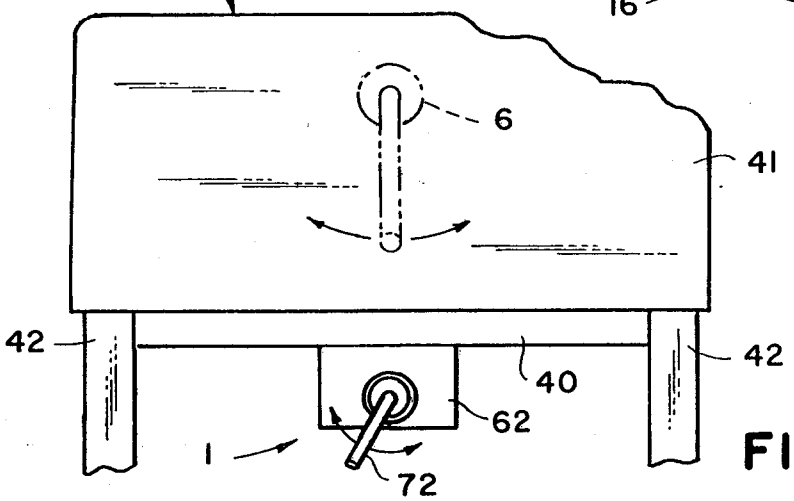
FIG. 2 is a partially schematic, fragmentary, end elevational view of an end panel of the bed in which a drive portion of the free-engaging drive unit is mounted.

Crank 7 is connected to a crank shaft 77 (FIGS. 3 and 4) which is rotatably mounted in foot board 41 by a mating bearing 78. A sprocket 79 is attached to the interior end of crank shaft 77, and is located within the interior of foot board 41. A roller chain 81 extends between and meshes with sprockets 69 and 79 to transmit rotary motion therebetween, and defines a portion of one means for operatively connecting crank 7 with drive shaft 64. A shroud or cover 82 extends over the exposed portion of sprocket 79 and roller chain 81 to protect the same. Rotation of crank 7 in a given rotational direction rotates drive arm 72 in a similar direction, as schematically illustrated in FIG. 2.

As best illustrated in FIGS. 6–9, driven coupling member 9 comprises a second drive shaft 88 which is mounted in spring frame 3 for axial rotation about a longitudinal axis thereof. Second drive shaft 88 defines one means for operably connecting driven coupling member 9 with control shaft 7. In the illustrated example, second drive shaft 88 comprises an elongated, cylindrically shaped, hollow tube. The head end 89 of second drive shaft 88 is shaped to be closely received over an associated controller shaft 7, which in the illustrated example is controller shaft *7b* for the high/low bed adjustment. The head end 89 of second drive shaft 88 includes a radially inwardly extending key 90 which is received in a mating notch or keyway 91 in controller shaft *7b*, so as to transmit rotary motion therebetween. A lock bushing 92 is rotatably mounted on the foot end 93 of second drive shaft 88, and detachably mounts the foot end 93 of second drive shaft 88 in bedspring 3, as described in greater detail hereinafter. Lock bushing 92 defines a portion of one means for positioning drive shaft 88 adjacent to the end of bedspring 3 in a predetermined relationship with drive coupling member 8.

A rigid driven arm 96 is connected with second drive shaft 88 for rotation therewith, and protrudes radially outwardly from the longitudinal axis of second drive shaft 88. The illustrated driven arms 96 include a pair of oppositely extending prongs 97 that define a claw in which drive arm 72 is received. Claw prongs 97 are bent outwardly at an angle of approximately 30 degrees from the longitudinal axis of second drive shaft 88, and extend outwardly a distance in the nature of 0.5 to 1.5 inches. Each claw prong 97 has opposing side faces 99 and 100 (FIGS. 8 and 9) which intersect in an acute angle along the longitudinal center line of the prong. Hence, prongs 97 have a generally V-shaped transverse cross-sectional configuration, with a rounded apex.

It is to be understood that both drive coupling 8 and driven coupling 9 may have either one or more than one meshing members to rotationally interconnect the same when the two halves of the coupling are converged. The single finger drive arm 72, and two-pronged driven claw 96 disclosed herein are particularly advantageous because they readily mesh together without synchronization, yet provide a reasonably direct drive connection that does not result in an undesirable amount of lost motion.

Lock bushing 92 (FIG. 7) is substantially identical to the lock bushing arrangement disclosed in the above-identified related patent application, and forms a quick-disconnect latch with bedspring 3. More specifically, with reference to FIGS. 6–9, an aperture 105 extends through a vertical wall portion 106 of foot cross member 17, and includes opposite, radially oriented slots 107. Two pairs of stops 108 and 109 protrude outwardly from the exterior side of frame wall 106, and are positioned approximately 90 degrees from the slots 107 to form a snap-lock with lock bushing 92. Lock bushing 92 includes a cylindrically shaped body with ears 111 protruding radially outwardly therefrom in a diametrically opposed fashion. Ears 111 are shaped to be received through the slots 107. Lock bushing 92 has a radially extending notch 112, which has a width slightly greater than frame wall 106, and divides ears 111 into forward and rearward halves. To lock second drive shaft 88 onto spring frame 3, lock bushing 92 is rotated until the forward halves of lock bushing ears 111 are positioned between stops 108 and 109 to define a snap-lock. A pin 113 extends through second drive shaft 88, and retains lock bushing 92 thereon in an axial or longitudinal direction.

In operation, free-engaging drive unit 1 is used in conjunction with the Joerns modular drive bed in the following manner. When the user desires a free-engaging drive unit on a new bed, adjustable bed 2 is provided with a bedspring 3, a standard head panel 4, and a special foot panel 5 in which the drive coupling member 8 of free-engaging drive unit 1 is already installed. A driven coupling member 9 also accompanies the special foot panel 5. If an existing Joerns modular drive unit bed is to be modified to include the free-engaging drive unit 1, the existing foot panel is removed from the existing bedspring 3, and a new special foot panel 5 in which drive coupling member 8 is installed is attached to the bedspring. In either case, before foot panel 5 is attached to bedspring 3, the user inserts the head end 89 of second drive shaft 88 through frame aperture 105 from the exterior side of the foot of the bed, until the head end of the second drive shaft is closely received over the mating controller shaft *7b*. Second drive shaft 88 is rotated until key 90 is engaged in mating keyway 91. Lock bushing 92 is then rotated into the locked position, thereby securely yet detachably mounting the driven coupling member 9 in bedspring 3.

Figure 11:
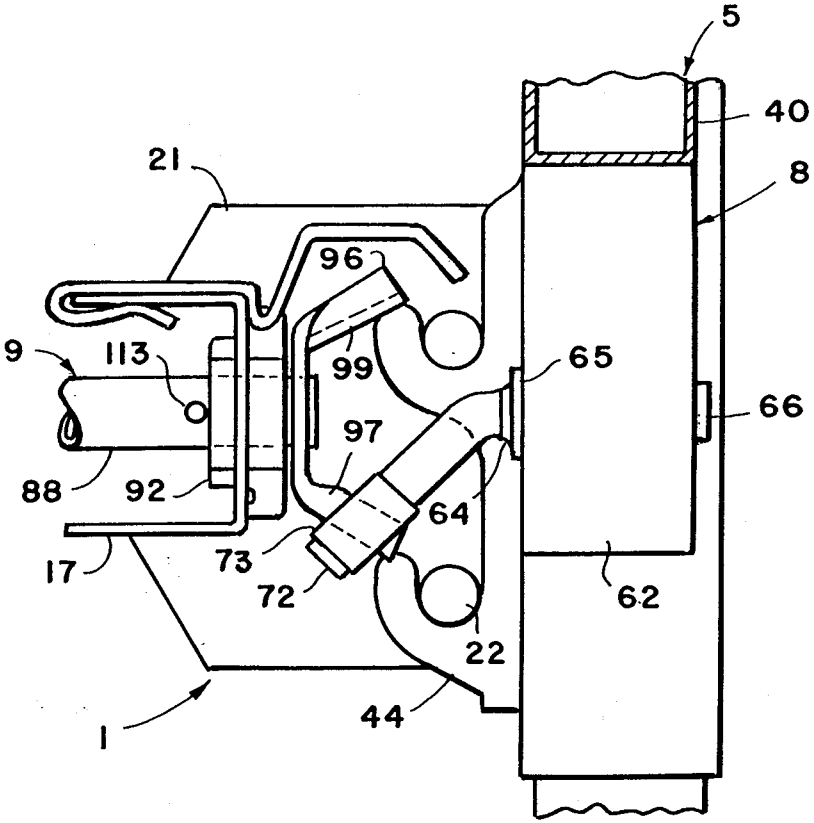
FIG. 11 is a fragmentary, vertical cross-sectional view of the adjustable bed, shown with the mattress support frame and mating end panel portions in an engaged position.
Figure 10:
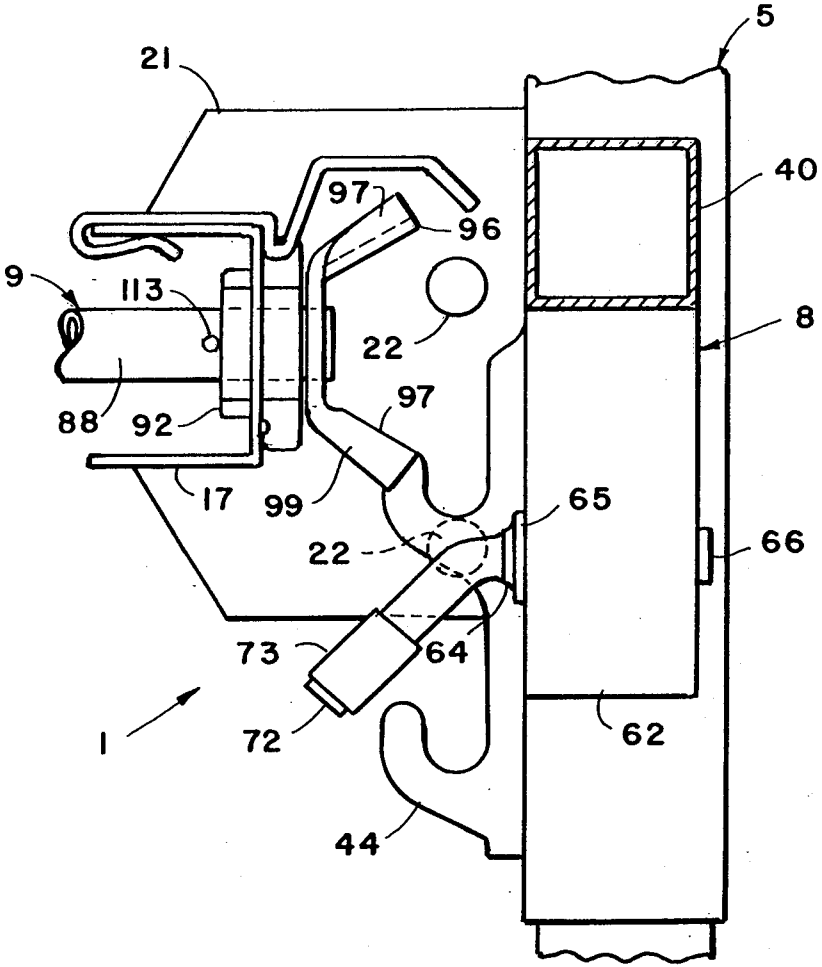
FIG. 10 is a fragmentary, vertical cross-sectional view of the adjustable bed, shown with a mattress support frame and mating end panel portions thereof in a disengaged position.

Foot panel 5 is then assembled on bedspring 3 in the manner best illustrated in FIGS. 10 and 11. The keeper studs 22 on bedspring 3 are aligned with the mating corner hooks 44 on foot panel 5, as shown in FIG. 10. The foot end of bedspring 3 is then lowered downwardly so as to position keeper studs 22 within the mating corner hooks 44, as shown in FIG. 11, thereby structurally connecting bedspring 3 with foot panel 5. This assembly motion automatically and simultaneously meshes drive coupling member 8 with driven coupling member 9. More specifically, first drive shaft 64 and second drive shaft 88 are positioned such that their longitudinal axis are substantially concentric. Drive arm 72 is positioned between the claw prongs 97, and bushing 73 is disposed to abut an adjacent one of the side faces 99 and 100 of claw prongs 97.

It is to be understood that adjustable bed 2 may include more than one free-engaging drive unit 1. For instance, in the illustrated adjustable bed 2, all three controller shafts *7a*, *7b* and *7c* may be manipulated by an associated drive coupling 8 on foot panel 5 and a driven coupling 9 on bedspring 3. A transmission (not shown), such as the device disclosed in U.S. Pat. No. 3,281,873 to Joerns Furniture Company, may be provided to manipulate all bed functions from a single crank 6.

To manipulate the bed function associated with free-engaging drive unit 1, which in the illustrated example adjusts the elevation of bed 2, the user grasps handle 58 and rotates crank 6 in the desired direction. The rotary motion of crank 6 is transmitted to drive arm 72, which in turn abuts one of the two claw prongs 97 on driven arm 96 to rotate second drive shaft 8. This rotary motion in turn rotates controller shaft *7b* to extend and retract telescoping legs 43. In the event that first drive shaft 65 is not perfectly aligned with second drive shaft 88, drive arm 72 will translate over the side face of the associated claw prong 97 as the coupling is rotated. In order to alleviate wear and noise caused by this rubbing action, bushing 73 rotates axially on drive arm 72 to accommodate for this misalignment.

When the user has adjusted the bed to its desired position, handle 58 is released, and the bed will maintain its desired position. Gravitational forces will normally orient crank arm 57 in a generally vertical direction, so as to impart a neat appearance to adjustable bed 2, and keep crank 6 out of the way. Since the engagement between drive arm 72 and claw prongs 97 has approximately 180 degrees of play, the mating coupling members permit the crank arm to assume a vertical orientation in the stowed or parked position.

In the event that the user wishes to convert adjustable bed 2 into a fully motorized mode, second drive shaft 88 can be easily removed from bedspring 3, and a motor drive unit 51 installed in its place. The drive coupling member 8 of the free-engaging drive unit 1 will not interfere with the operation of motor drive unit 51.

Free-engaging drive unit 1 provides an uncomplicated mechanism for controlling various bed functions from a conveniently located crank on the end of the bed 2. The mating halves 8 and 9 of the drive unit 1 automatically mesh when the end panels 4 and 5 of bed 2 are connected with bedspring 3. The coupling halves 8 and 9 also self-adjust for any slight misalignment between the two coupling members.

In the foregoing description, it will be readily appreciated by those skilled in the art that modifications may be made to the invention without departing from the concepts disclosed herein. Such modifications are to be considered as included in the following claims, unless these claims by their language expressly state otherwise.

The embodiments of the invention in which an exclusive property or privilege is claimed are defined as follows:

1. In an adjustable bed having a mattress support frame with opposite ends, detachable end panels connected with and supporting said mattress support frame, and a controller shaft that is rotated to manipulate an adjustable portion of said bed, the improvement of a free-engaging drive unit, comprising:

a crank rotatably mounted on a conveniently accessible portion of one of said end panels;

a drive coupling member, including:

a housing;

a first drive shaft mounted in said housing for axial rotation about a longitudinal axis of said first drive shaft;

a rigid drive arm connected with said first drive shaft for rotation therewith, and protruding radially outwardly from the longitudinal axis of said first drive shaft;

means for operably connecting said crank with said first drive shaft, whereby rotation of said crank rotates said drive arm;

a driven coupling member, including:

a second drive shaft mounted in said mattress support frame for axial rotation about a longitudinal axis thereof;

means for operably connecting said second drive shaft with said controller shaft to transmit rotary motion therebetween;

means for positioning said second drive shaft adjacent to the end of said mattress support frame associated with said one end panel;

a rigid driven arm connected with said second drive shaft for rotation therewith, and protruding radially outwardly from the longitudnal axis of said second drive shaft;

at least one of said drive arm and said driven arm protruding axially outwardly toward the other of said drive arm and said driven arm, such that when rotated, said drive arm abuts said driven arm at a location spaced radially outwardly from the longitudinal axis of said driven arm, and rotates said driven arm; and means for mounting said drive coupling member on said one bed end and said driven coupling member on said mattress support frame in a predetermined relative position wherein when said bed is assembled, said first and second drive shafts are aligned substantially concentrically, such that connection of said one end panel with the associated end of said mattress support frame automatically meshes said drive arm with said driven arm to transmit rotary motion from said crank to said controller shaft and thereby effect bed adjustment.

2. An adjustable bed as set forth in claim 1, wherein:

at least one of said drive arm and said driven arm comprises a single bent finger to facilitate meshing with the other of said drive arm and said driven arm even when said drive arm and driven arm are not perfectly aligned.

3. An adjustable bed as set forth in claim 2, including:

a bushing rotatably mounted on one of said drive arm and said driven arm, and positioned thereon to abut the other of said drive arm and said driven arm to facilitate transmitting rotary motion therebetween.

4. An adjustable bed as set forth in claim 3, wherein:

said bushing is annularly shaped, and constructed from a resilient material to reduce noise.

5. An adjustable bed as set forth in claim 4, wherein:

said other of said drive arm and said driven arm includes a second rigid arm extending generally diametrically opposite to said first name arm to define a claw in which said one drive arm is selectively received.

6. An adjustable bed as set forth in claim 5, wherein:

said one end panel defines a foot end of said bed.

7. An adjustable bed as set forth in claim 6, including:

means for detachably connecting said second drive shaft with said mattress support frame, and defining at least a portion of said connecting means and said positioning means.

8. An adjustable bed as set forth in claim 7, wherein said detachable connecting means comprises:

a first coupling member located on said controller shaft;

a second coupling member located on one end of said second drive shaft, and shaped to mate with said first coupling member to releasably and selectively interconnect the same;

a first, quick-disconnect latch member located on the associated end of said mattress support frame;

a second, quick-disconnect latch member located on the other end of said second drive shaft, and shaped to mate with said first quick-disconnect latch member to selectively support at least a portion of said second drive shaft on said mattress support frame.

9. An adjustable bed as set forth in claim 8, wherein:

said first and second coupling members include means for telescopingly interconnecting the same, whereby the one end of said second drive shaft is supported on said mattress support frame by said controller shaft.

10. An adjustable bed as set forth in claim 9, wherein:

said associated end of said mattress support frame includes a frame foot member disposed at a marginal portion thereof in which said first, quick-disconnect latch member is positioned.

11. An adjustable bed as set forth in claim 10, wherein said first quick-disconnect latch member comprises:

an aperture extending through a vertical wall portion of said frame foot member; said aperture being shaped to receive said second quick-disconnect latch member therein, and including at least one radially oriented slot; and at least one pair of laterally spaced apart stops protruding outwardly from the exterior side of the vertical wall portion of said frame foot member, and positioned at a spaced apart, angular measure from said slot to form a snap-lock with said second quick-disconnect latch member.

12. An adjustable bed as set forth in claim 11, wherein said second quick-disconnect latch member comprises:

a lock bushing rotatably mounted on said second drive shaft adjacent the other end thereof, and including a cylindrically-shaped body, with at least one ear protruding radially outwardly therefrom; said ear being shaped for longitudinal insertion into said slot, and having a radially extending notch, which has a width slightly greater than the thickness of the vertical wall portion of said frame foot member, and divides said ear into forward and rearward halves, whereby to lock said second drive shaft onto said mattress support frame, said lock bushing is rotated until the forward half of said lock bushing ear is positioned between said stops to define said snap-lock.

13. An adjustable bed as set forth in claim 12, wherein:

said aperture includes a second radially oriented slot, shaped substantially identical to said first named slot; said first and second slots being located on diametrically opposite sides of said aperture.

14. An adjustable bed as set forth in claim 13, including:

a second pair of stops protruding outwardly from the exterior side of the vertical wall portion of said frame foot member, and positioned in alignment with said first named pair of stops.

15. An adjustable bed as set forth in claim 14, wherein:

said lock bushing includes a second, radially protruding ear, shaped substantially identical to said first named ear; said first and second ears being located on diametrically opposite sides of said lock bushing body.

16. An adjustable bed as set forth in claim 15, wherein:

said first coupling member comprises a keyway extending parallel with the longitudnal axis of said controller shaft; and said second coupling member comprises a tubular terminal portion of the one end of said second drive shaft which is shaped for close reception on said controller shaft, and includes a key configured for mating reception on said keyway.

17. An adjustable bed as set forth in claim 16, wherein:

said lock bushing is constructed of a self-lubricating, resilient material; and said stops comprise hemispherically shaped knobs.

18. An adjustable bed as set forth in claim 17, wherein:

said second drive shaft comprises a cylindrically-shaped, straight, tube, having a substantially uniform cross-sectional shape which permits said tube to be inserted through said aperture from the exterior side of said foot frame member.

19. An adjustable bed as set forth in claim 18, including:

a motor drive unit adapted to replace said free-engaging drive unit, and having first and second ends, with an output shaft protruding from the first end of said motor drive unit;

a third coupling member located on the output shaft of said motor drive unit, and shaped to mate with said first coupling member to releasably and selectively interconnect the output shaft of said motor drive unit with the controller shaft of said bed and transmit rotary motion therebetween;

means for preventing relative rotation between said motor drive unit and said mattress support frame during adjustment of said bed; and a third, quick-disconnect latch member located on the second end of said motor drive unit, and shaped to mate with said first quick-disconnect latch member to selectively support said motor drive unit on said mattress support frame, whereby even relatively unskilled personnel without tools can remove said second drive shaft from said bed, and replace the same with said motor drive unit.

20. An adjustable bed as set forth in claim 19, including:

a manual crank unit adapted to replace said free-engaging drive unit, and having first and second ends, with a handle protruding from the second end of said manual crank unit;

a fourth coupling member located on the first end of said manual crank unit, and shaped to mate with said first coupling member to releasably interconnect said manual crank unit with the controller shaft of said bed and transmit rotary motion therebetween; and a bearing located on the second end of said manual crank unit, and having a fourth quick-disconnect latch member thereon which mates with said first quick-disconnect latch member to selectively and rotatably support said manual crank unit on said bed frame, whereby even relatively unskilled personnel without tools can remove said motor drive unit from said bed for off-site repair, and replace the same with said manual crank unit to insure uninterrupted operation of said bed, without disturbing the patient.

21. An adjustable bed as set forth in claim 20, wherein:

said bed includes multiple controller shafts to manipulate different, adjustable portions of said bed; and multiple free-engaging drive units, motor drive units and manual crank units are provided to connect interchangeably with said multiple controller shafts.

22. An adjustable bed as set forth in claim 21, wherein:

said drive arm comprises said single bent finger, and defines said one of said drive arm and said driven arm.

23. An adjustable bed as set forth in claim 22, wherein:

said driven arm comprises said claw, and defines said other of said drive arm and said driven arm.

24. An adjustable bed as set forth in claim 1, including:

a bushing rotatably mounted on one of said drive arm and said driven arm, and positioned thereon to abut the other of said drive arm and said driven arm to facilitate transmitting rotary motion therebetween.

25. An adjustable bed as set forth in claim 1, wherein:

one of said drive arm and driven arm includes a second rigid arm extending generally diametrically opposite to said first named arm to define a claw in which the other one of said drive arm and said driven arm is selectively received.

26. An adjustable bed as set forth in claim 1, wherein:

said one end panel defines a foot end of said bed.

27. An adjustable bed as set forth in claim 1, including:

means for detachably connecting said second drive shaft with said mattress support frame, and defining at least a portion of said connecting means and said positioning means; said detachable connecting means comprising:

a first coupling member located on said controller shaft;

a second coupling member located on one end of said second drive shaft, and shaped to mate with said first coupling member to releasably and selectively interconnect the same;

a first, quick-disconnect latch member located on the associated end of said mattress support frame;

a second, quick-disconnect latch member located on the other end of said second drive shaft, and shaped to mate with said first quick-disconnect latch member to selectively support at least a portion of said second drive shaft on said mattress support frame.

28. An adjustable bed as set forth in claim 27, including:

a motor drive unit adapted to replace said free-engaging drive unit, and having first and second ends, with an output shaft protruding from the first end of said motor drive unit;

a third coupling member located on the output shaft of said motor drive unit, and shaped to mate with said first coupling member to releasably and selectively interconnect the output shaft of said motor drive unit with the controller shaft of said bed and transmit rotary motion therebetween;

means for preventing relative rotation between said motor drive unit and said mattress support frame during adjustment of said bed; and a third, quick-disconnect latch member located on the second end of said motor drive unit, and shaped to mate with said first quick-disconnect latch member to selectively support said motor drive unit on said mattress support frame, whereby even relatively unskilled personnel without tools can remove said second drive shaft from said bed, and replace the same with said motor drive unit.

29. An adjustable bed as set forth in claim 1, wherein:

said bed includes multiple controller shafts to manipulate different, adjustable portions of said bed; and multiple free-engaging drive units operably and selectively connect said crank with said multiple controller shafts.

30. In an adjustable bed having a mattress support frame with opposite ends, detachable end panels connected with and supporting said mattress support frame, and a controller shaft that is rotated to manipulate an adjustable portion of said bed, the improvement of a free-engaging drive unit, comprising:

a crank rotatably mounted on a conveniently accessible portion of one of said end panels;

a drive coupling half operably connected with said one end panel for axial rotation;

means for operably connecting said crank with said drive coupling half, whereby rotation of said crank rotates said drive coupling half;

a driven coupling half operably connected with said controller shaft for axial rotation therewith;

said drive coupling half and said driven coupling half being shaped to mesh when converged to transmit rotary motion therebetween;

said drive coupling member and said driven coupling member being positioned on said one bed end and on said mattress support frame in a predetermined relative position wherein when said bed is assembled, said drive coupling half and said driven coupling half are aligned substantially concentrically, such that connection of said one bed end with the associated end of said mattress support frame automatically meshes said drive coupling half with said drive coupling half to transmit rotary motion from said crank to said controller shaft and thereby effect bed adjustment.

31. A free-engaging, manual drive unit for adjustable beds having a mattress support frame with opposite ends, detachable end panels connected with and supporting the mattress support frame, and a controller shaft that is rotated in manipulate an adjustable portion of the bed; said free-engaging drive unit, comprising:

a crank adapted to be rotatably mounted on a conveniently accessible portion of one of the end panels;

a drive coupling member adapted for connection with the one end panel, and including:

a housing;

a first drive shaft mounted in said housing for axial rotation about a longitudinal axis of said first drive shaft; and a rigid drive arm connected with said first drive shaft for rotation therewith, and protruding radially outwardly from the longitudinal axis of said first drive shaft;

means for operably connectng said crank with said first drive shaft, whereby rotation of said crank rotates said drive arm;

a driven coupling member adapted for connection with the mattress support frame, and including:

a second drive shaft adapted to be mounted in the mattress support frame for axial rotation about a longitudinal axis thereof;

means for connecting said second drive shaft with said controller shaft to transmit rotary motion therebetween;

means for positioning said second drive shaft adjacent to the end of the mattress support frame associated with the one end panel; and a rigid driven arm connected with said second drive shaft for rotation therewith, and protruding radially outwardly from the longitudinal axis of said second drive shaft;

at least one of said drive arm and said driven arm protruding axially outwardly toward the other of said driven arm and said driven arm, such that when rotated, said drive arm abuts said driven arm at a location spaced radially outwardly from the longitudinal axis of said driven arm, and rotates said driven arm;

means for mounting said drive coupling member on the one bed end and said driven coupling member on the mattress support frame in a predetermined relative position wherein when the bed is assembled, said first and second drive shafts are aligned substantially concentrically, such that connection of the one end panel with the associated end of the mattress support frame automatically meshes said drive arm with said driven arm to transmit rotary motion from said crank to the controller shaft and thereby effect bed adjustment.

32. A manual drive unit as set forth in claim 31, wherein:

at least one of said drive arm and said driven arm comprises a single bent finger to facilitate meshing with the other of said drive arm and said driven arm.

33. A manual drive unit as set forth in claim 32, including:

a bushing rotatably mounted on one of said drive arm and said driven arm, and positioned thereon to abut the other of said drive arm and said driven arm to facilitate transmitting rotary motion therebetween.

34. A manual drive unit as set forth in claim 33, wherein:

said bushing is annularly shaped, and constructed from a resilient material to reduce noise.

35. A manual drive unit as set forth in claim 34, wherein:

the other of said drive arm and said driven arm includes a second rigid arm extending generally diametrically opposite to said first name arm to define a claw in which said drive arm is selectively received.

36. A manual drive unit as set forth in claim 35, including:

means for detachably connecting said second drive shaft with the mattress support frame, and defining at least a portion of said connecting means and said positioning means.

37. A manual drive unit as set forth in claim 36, wherein said detachable connecting means comprises:

a first coupling member adapted to be mounted on the controller shaft;

a second coupling member located on one end of said second drive shaft, and shaped to mate with said first coupling member to releasably and selectively interconnect the same;

a first, quick-disconnect latch member adapted to be mounted on the associated end of the mattress support frame; and a second, quick-disconnect latch member located on the other end of said second drive shaft, and shaped to mate with said first quick-disconnect latch member to selectively support at least a portion of said second drive shaft on said mattress support frame.

38. A manual drive unit as set forth in claim 37, wherein:

said drive arm comprises said single bent finger, and defines said one of said drive arm and said driven arm.

39. An adjustable bed as set forth in claim 38, wherein:

said driven arm comprises said claw, and defines said other of said drive arm and said driven arm.

40. A manual drive unit as set forth in claim 31, including:

a bushing rotatably mounted on one of said drive arm and said driven arm, and positioned thereon to abut the other of said drive arm and said driven arm to facilitate transmitting rotary motion therebetween.

41. A manual drive unit as set forth in claim 31, wherein:

one of said drive arm and said arm includes a second rigid arm extending generally diametrically opposite to said first name arm to define a claw in which the other of said drive arm and said driven arm is selectively received.

* * * * *

UNITED STATES PATENT AND TRADEMARK OFFICE

CERTIFICATE OF CORRECTION

PATENT NO. : 4,660,236

DATED : April 28, 1987

INVENTOR(S) : Warren J. Peterson

It is certified that error appears in the above-identified patent and that said Letters Patent is hereby corrected as shown below:

Column 4, lines 9 and 10:

"Motor drive unit 50 and manual crank unit 51" should be --Motor drive unit 51 and manual crank unit 50--

Column 12, line 31, claim 31:

"in" should be --to--

Column 12, line 66, claim 31:

"driven" (first occurrence) should be --drive--

Signed and Sealed this

Twenty-sixth Day of January, 1988

*Attest:*

DONALD J. QUIGG

*Attesting Officer*

*Commissioner of Patents and Trademarks*